US011773860B2

(12) United States Patent
Huang et al.

(10) Patent No.: US 11,773,860 B2
(45) Date of Patent: Oct. 3, 2023

(54) FAN ASSEMBLY

(71) Applicant: GIGA-BYTE TECHNOLOGY CO.,LTD., New Taipei (TW)

(72) Inventors: Shun-Chih Huang, New Taipei (TW); Ching-Yu Lu, New Taipei (TW); Kai-Yan Huang, New Taipei (TW); Liang Yu Wu, New Taipei (TW); Jeffrey Lee, New Taipei (TW)

(73) Assignee: GIGA-BYTE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/547,226

(22) Filed: Dec. 10, 2021

(65) Prior Publication Data

US 2022/0186923 A1 Jun. 16, 2022

(30) Foreign Application Priority Data

Dec. 16, 2020 (TW) ..... 109144366

(51) Int. Cl.

| | |
|---|---|
| ***F21V 29/00*** | (2015.01) |
| ***F04D 29/00*** | (2006.01) |
| ***F04D 19/00*** | (2006.01) |
| ***F21V 7/00*** | (2006.01) |

(Continued)

(52) U.S. Cl.

CPC ..... *F04D 29/005* (2013.01); *F04D 19/002* (2013.01); *F21V 7/0008* (2013.01); *F21V 33/0096* (2013.01); *F21Y 2113/13* (2016.08)

(58) Field of Classification Search

None

See application file for complete search history.

(56) References Cited

U.S. PATENT DOCUMENTS

| | | | |
|---|---|---|---|
| 6,790,003 B1 | 9/2004 | Hu et al. | |
| 10,082,286 B1 * | 9/2018 | Huang | G02B 6/0008 |

(Continued)

FOREIGN PATENT DOCUMENTS

| | | |
|---|---|---|
| CN | 206368833 | 8/2017 |
| CN | 207795629 | 8/2018 |
| CN | 207795630 | 8/2018 |

(Continued)

OTHER PUBLICATIONS

"Search Report of Europe Counterpart Application", dated Apr. 28, 2022, p. 1-p. 5.

*Primary Examiner* — Juan G Flores

(74) *Attorney, Agent, or Firm* — JCIPRNET

(57) ABSTRACT

A fan assembly including a base, a fan, a light-emitting unit, and a lighting effect component is provided. The fan is rotatably disposed above the base, and includes a central part and multiple blades extending outwards from the central part, and each of the blades has a top surface away from the base. The light-emitting unit is disposed on the base and located between the base and the central part of the fan. The lighting effect component is disposed on the base and surrounds the light-emitting unit. A projection of the lighting effect component projected onto the base is greater than a projection of the fan projected onto the base. A height of the lighting effect component protruding from the base is less than a distance between the top surface of one of the blades and the base. The lighting effect component includes an inclined inner surface.

10 Claims, 5 Drawing Sheets

(51) Int. Cl.
*F21V 33/00* (2006.01)
*F21Y 113/13* (2016.01)

(56) References Cited

U.S. PATENT DOCUMENTS

| | | | | |
|---|---|---|---|---|
| 10,101,020 | B2 * | 10/2018 | Hung | F04D 29/005 |
| 2019/0063740 | A1 | 2/2019 | Huang et al. | |

FOREIGN PATENT DOCUMENTS

| | | |
|---|---|---|
| EP | 3613989 | 2/2020 |
| KR | 20100053366 | 5/2010 |
| TW | M500287 | 5/2015 |

* cited by examiner

FAN ASSEMBLY

CROSS-REFERENCE TO RELATED APPLICATION

This application claims the priority benefit of Taiwan application serial no. 109144366, filed on Dec. 16, 2020. The entirety of the above-mentioned patent application is hereby incorporated by reference herein and made a part of this specification.

BACKGROUND

Technical Field

The disclosure relates to a fan assembly, and in particular to a fan assembly with special visual effects.

Description of Related Art

As users have an increasing demand for visual effects, a goal of current research concerning a fan assembly on a motherboard is, in addition to providing heat-dissipation effects, providing users with special visual effects on the premise of taking into account heat-dissipation performance.

SUMMARY

The disclosure provides a fan assembly that takes into account heat-dissipation performance and provides special visual effects.

A fan assembly of the disclosure includes a base, a fan, a light-emitting unit, and a lighting effect component. The fan is rotatably disposed above the base, and includes a central part and multiple blades extending outwards from the central part, and each of these blades has a blade top surface away from the base. The light-emitting unit is disposed on the base and located between the base and the central part of the fan. The lighting effect component is disposed on the base and surrounds the light-emitting unit; a projection of the lighting effect component onto the base is greater than a projection of the fan onto the base; a height of the lighting effect component protruding from the base is less than a distance between the blade top surface and the base; the lighting effect component includes an inclined inner surface; and light emitted by the light-emitting unit is adapted for emitting to the inclined inner surface and being reflected towards a direction away from the base.

In an embodiment of the disclosure, each of the above-mentioned blades includes a blade bottom surface opposite to the blade top surface, and the height of the lighting effect component protruding from the base is less than or equal to a distance between the blade bottom surface and the base.

In an embodiment of the disclosure, the above-mentioned fan assembly further includes a fan guard which is disposed on the base and surrounds the fan and the lighting effect component. A height of the fan guard protruding from the base is greater than or equal to the distance between the blade top surface and the base.

In an embodiment of the disclosure, the above-mentioned fan assembly further includes an arc reflector which is disposed on a central part bottom surface of the central part of the fan and rotates as the fan rotates. The arc reflector includes an opening, and a portion of the light emitted by the light-emitting unit is adapted for being reflected by the arc reflector and passing through the opening to be incident on the inclined inner surface.

In an embodiment of the disclosure, the above-mentioned fan assembly further includes a light-collecting component; each of these blades includes a blade bottom surface opposite to the blade top surface; the light-collecting component is disposed on the blade bottom surface of one of the blades and extends towards the direction of the base; and a portion of the light emitted by the light-emitting unit is adapted for being focused on the inclined inner surface by the light-collecting component.

In an embodiment of the disclosure, the above-mentioned light-collecting component is disposed on an end of the blade bottom surface away from the central part.

In an embodiment of the disclosure, the above-mentioned light-collecting component is a bar-shaped structure extending from an end close to the central part to an end away from the central part of the blade bottom surface.

In an embodiment of the disclosure, an inclination angle of the above-mentioned inclined inner surface is between 30 degrees and 60 degrees.

In an embodiment of the disclosure, the above-mentioned light-emitting unit includes a red light-emitting diode, a green light-emitting diode, and a blue light-emitting diode.

In an embodiment of the disclosure, the above-mentioned lighting effect component is in a closed annular shape.

Based on the above, the light-emitting unit of the fan assembly of the disclosure is located between the base and the central part of the fan, and the lighting effect component is disposed on the base and surrounds the light-emitting unit. The projection of the lighting effect component onto the base is greater than the projection of the fan onto the base, and the height of the lighting effect component protruding from the base is less than the distance between the blade top surface and the base. The light emitted by the light-emitting unit is emitted to the inclined inner surface of the lighting effect component, and is reflected by the inclined inner surface to be directed towards the direction away from the base. With the above design, users see the visual effect generated by the light being reflected by the lighting effect component from the front side of the fan assembly. In addition, since the height of the lighting effect component protruding from the base is less than the distance between the blade top surface and the base, the low-height lighting effect component is less likely to damage the wind flow of the fan; therefore, a good heat-dissipation effect is still maintained.

DESCRIPTION OF THE EMBODIMENTS

Figure 1:
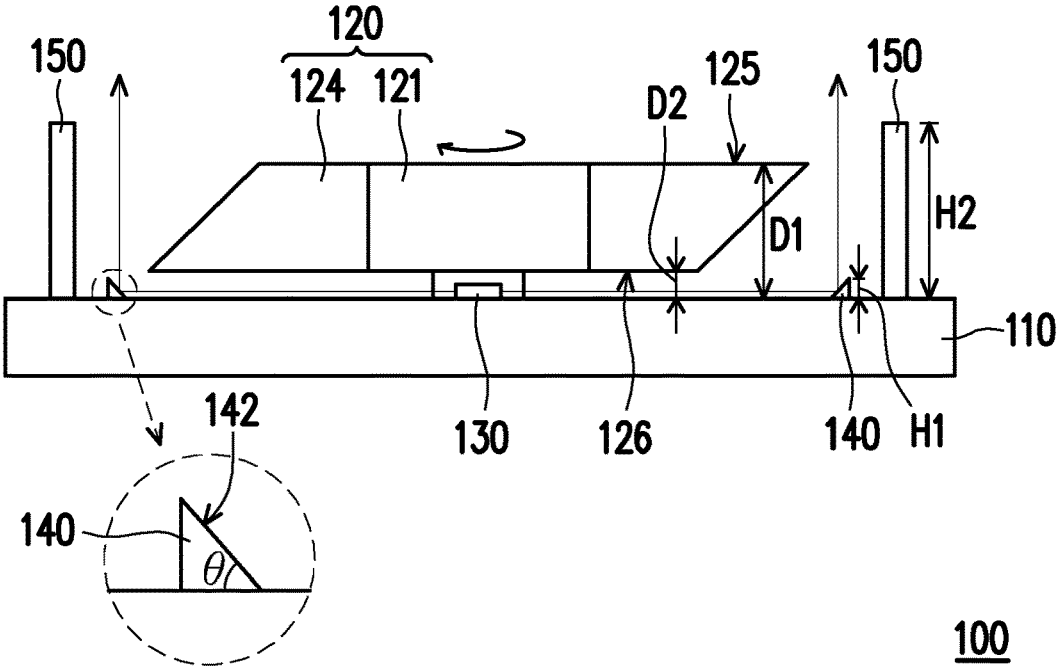
FIG. 1 is a schematic cross-sectional diagram of a fan assembly according to an embodiment of the disclosure.
Figure 2:
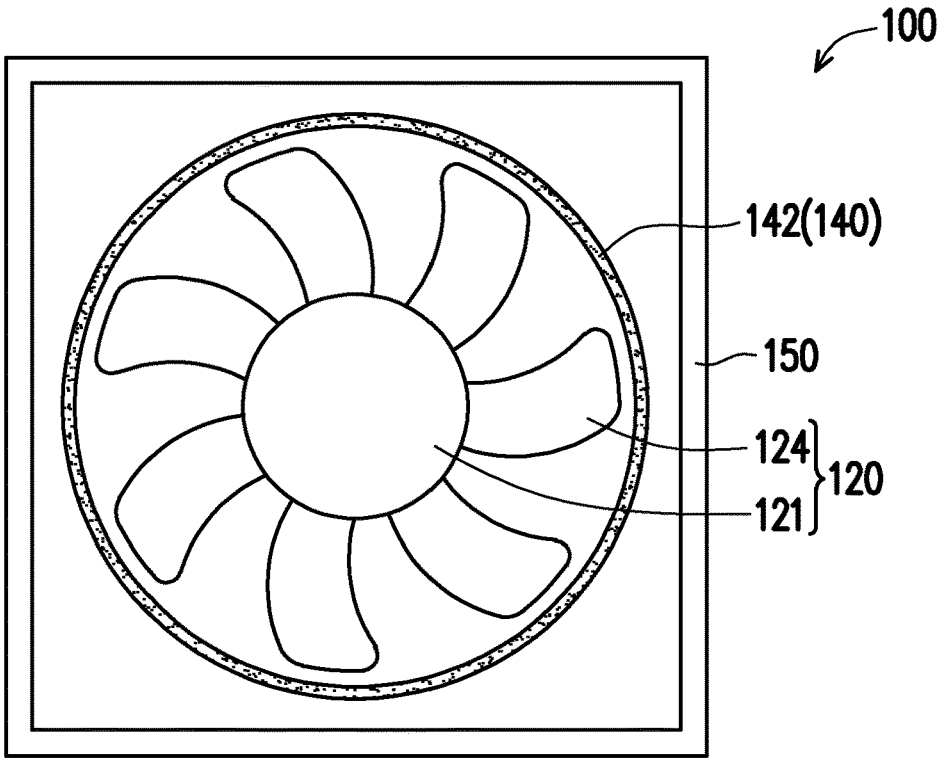
FIG. 2 is a top schematic diagram of the fan assembly of FIG. 1.

FIG. 1 is a schematic cross-sectional diagram of a fan assembly according to an embodiment of the disclosure. FIG. 2 is a top schematic diagram of the fan assembly of FIG. 1. Referring to FIGS. 1 and 2, in this embodiment, a fan assembly 100 is, for example, disposed on a display card (not shown), but a heat source applied by the fan assembly 100 is not limited thereto. The fan assembly 100 includes a base 110, a fan 120, a light-emitting unit 130, and a lighting effect component 140.

The fan 120 is rotatably disposed above the base 110. The fan 120 includes a central part 121 and multiple blades 124 extending outwards from the central part 121. The light-emitting unit 130 is disposed on the base 110 and between the base 110 and the central part 121 of the fan 120.

The lighting effect component 140 is disposed on the base 110 and surrounds the light-emitting unit 130. As shown in FIG. 2, in this embodiment, the projection of the lighting effect component 140 onto the base 110 is greater than the projection of the fan 120 onto the base 110. Therefore, the lighting effect component 140 is not blocked by the fan 120, and the user may see the lighting effect component 140 from the front side (for example, looking down from the top of FIG. 1) of the fan assembly 100.

In this embodiment, the lighting effect component 140 includes an inclined inner surface 142 that is inclined towards the light-emitting unit 130. An inclination angle θ of the inclined inner surface 142 is between 30 degrees and 60 degrees, for example, 45 degrees, but the inclination angle θ of the inclined inner surface 142 is not limited thereto. In addition, in this embodiment, the lighting effect component 140 is in a closed annular shape, but in other embodiments, the lighting effect component 140 may be in a non-closed annular shape.

In this embodiment, the light-emitting unit 130 may, for example, emit light radially, and the light emitted by the light-emitting unit 130 is adapted for emitting to the inclined inner surface 142 of the lighting effect component 140 and being reflected towards a direction away from the base 110. Therefore, the user may see the visual effect generated by the light being reflected by the lighting effect component 140 from the front side of the fan assembly 100.

It should be noted that, as shown in FIG. 1, the blades 124 have a blade top surface 125 away from the base 110 and a blade bottom surface 126 opposite to the blade top surface 125. A height H1 of the lighting effect component 140 protruding from the base 110 is less than a distance D1 between the blade top surface 125 and the base 110. In this embodiment, the height H1 of the lighting effect component 140 protruding from the base 110 is less than or equal to a distance D2 between the blade bottom surface 126 and the base 110. Since the design of a low-height lighting effect component 140 is less likely to damage the wind flow of the fan 120, the fan assembly 100 may maintain a good heat-dissipation effect.

In addition, the fan assembly 100 may optionally include a fan guard 150. As shown in FIG. 1, the fan guard 150 is disposed on the base 110 and surrounds the fan 120 and the lighting effect component 140. A height H2 of the fan guard 150 protruding from the base 110 is greater than or equal to the distance D1 between the blade top surface 125 and the base 110, so the fan guard 150 may be used to protect the fan 120 by reducing the probability of foreign objects directly contacting the fan 120. In addition, the fan guard 150 may also be used to prevent the user's hand from directly contacting the rotating blades 124.

Figure 3:
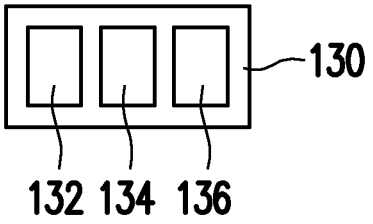
FIG. 3 is a schematic diagram of a light-emitting unit of the fan assembly of FIG. 1.

FIG. 3 is a schematic diagram of a light-emitting unit of the fan assembly of FIG. 1. Referring to FIG. 3, in this embodiment, the light-emitting unit 130 includes a red light emitting diode 132, a green light emitting diode 134, and a blue light emitting diode 136. Of course, in other embodiments, the light-emitting unit 130 may only have a monochromatic light emitting diode, and the type of the light-emitting unit 130 is not limited thereto.

The light-emitting unit 130 may be controlled by a controller (not shown) to generate different light-emitting effects. Specifically, a manufacturer may use a tachometer pin (TACHO Pin, not shown) of the fan 120 to measure the waveform of the rotation speed of the fan 120 according to the desired lighting effect, and write relevant information into the controller. The controller may control the switches of the red light emitting diode 132, the green light emitting diode 134, and the blue light emitting diode 136 in the light-emitting unit 130 according to the rotation speed to obtain different lighting effects. Alternatively, all the colors that the light-emitting unit 130 may emit may be displayed on the lighting effect component 140.

Therefore, the user may see different colors on the lighting effect component 140 or see effects such as marquee, gradient color, breathing light effect, flashing light effect, etc. Due to the principle of persistence of vision, these lighting effects may appear in human eyes at the same time or sequentially.

Figure 4:
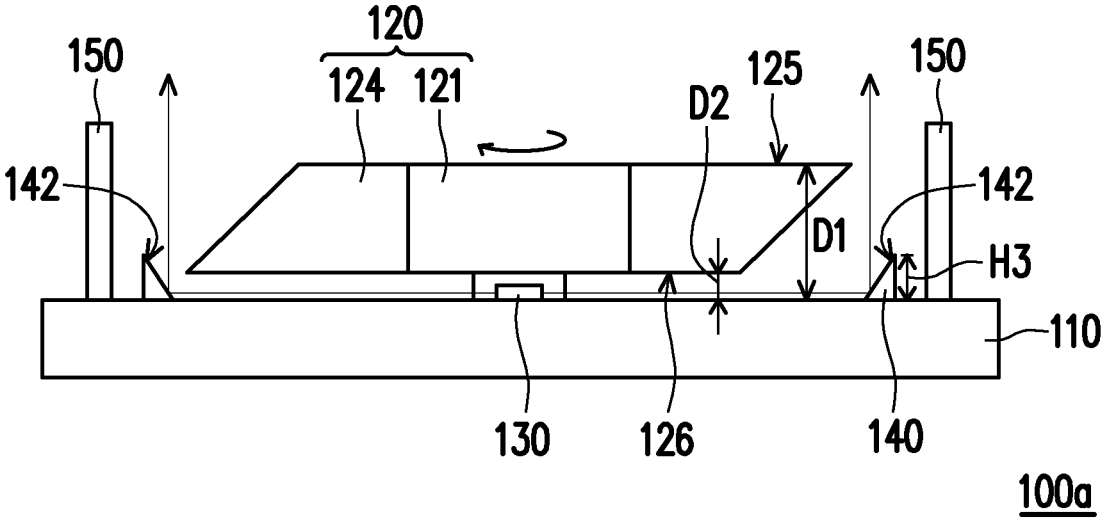
FIG. 4 is a schematic cross-sectional diagram of a fan assembly according to another embodiment of the disclosure.

FIG. 4 is a schematic cross-sectional diagram of a fan assembly according to another embodiment of the disclosure. Referring to FIG. 4, the main difference between a fan assembly 100*a* of FIG. 4 and the fan assembly 100 of FIG. 1 is as follows. In this embodiment, a height H3 of the lighting effect component 140 protruding from the base 110 is greater than the distance D2 between the blade bottom surface 126 and the base 110, and is less than the distance D1 between the blade top surface 125 and the base 110. Since the height H3 of the lighting effect component 140 is still low, the lighting effect component 140 is less likely to affect the airflow of the fan 120. In addition, since the height of the lighting effect component 140 of FIG. 4 is relatively large, the lighting effect component 140 of FIG. 4 may have a larger inclined inner surface 142, and may provide a more significant visual effect.

Figure 5:
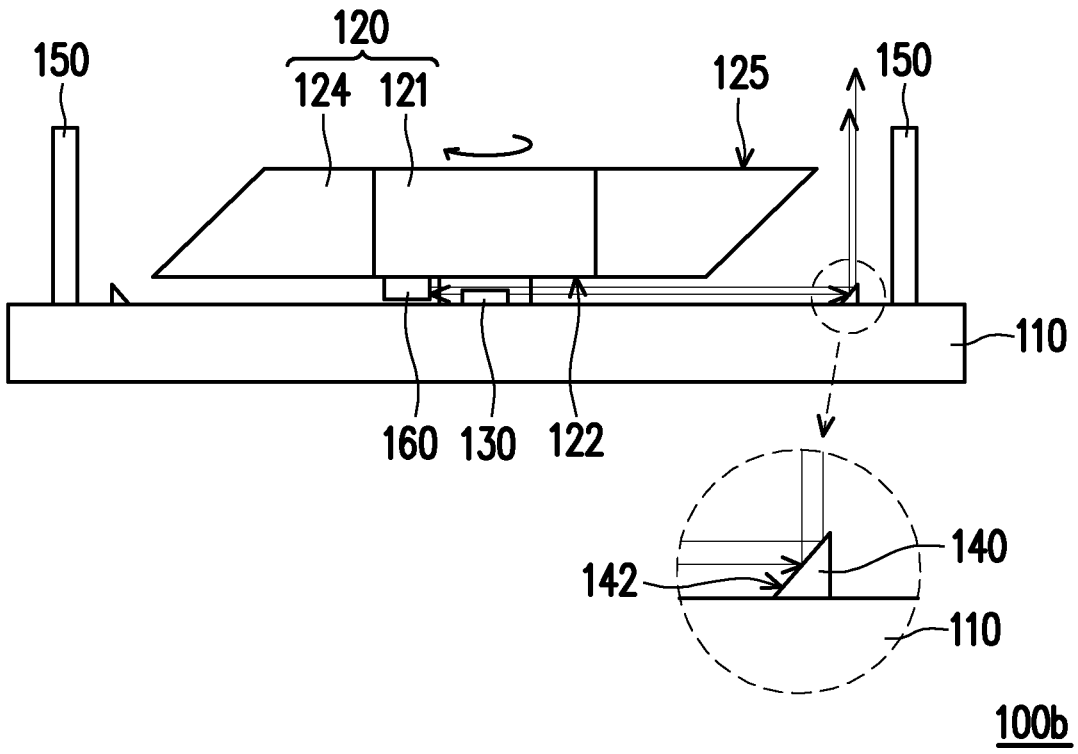
FIG. 5 is a schematic cross-sectional diagram of a fan assembly according to another embodiment of the disclosure.
Figure 6:
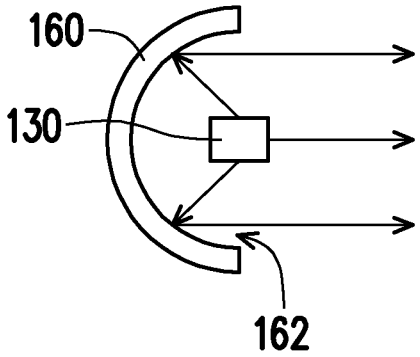
FIG. 6 is a schematic diagram of light of a light-emitting unit of the fan assembly of FIG. 5 being reflected by an arc reflector.

FIG. 5 is a schematic cross-sectional diagram of a fan assembly according to another embodiment of the disclosure. FIG. 6 is a schematic diagram of light of a light-emitting unit of the fan assembly of FIG. 5 being reflected by an arc reflector. Referring to FIGS. 5 and 6, the main difference between a fan assembly 100*b* in FIG. 5 and the fan assembly 100 in FIG. 1 is as follows. In this embodiment, the fan assembly 100*b* further includes an arc reflector 160, which is disposed on a central part bottom surface 122 of the central part 121 of the fan 120 and rotates as the fan 120 rotates.

As shown in FIG. 6, in this embodiment, the arc reflector 160, for example, surrounds 180 degrees of the light-emitting unit 130. But in other embodiments, the arc reflector 160 may surround an angle between 60 degrees and 240 degrees of light-emitting unit 130, and the angle of the light-emitting unit 130 being surrounded by the arc reflector 160 is not limited thereto.

The arc reflector 160 includes an opening 162, and a portion of the light emitted by the light-emitting unit 130 moves away from the direction of the arc reflector 160 and is directly directed towards the inclined inner surface 142 of the lighting effect component 140 in FIG. 5. A portion of the light emitted by the light-emitting unit 130 is adapted for being reflected by the arc reflector 160 and passing through the opening 162 of FIG. 6 to be incident on the inclined inner surface 142 of the lighting effect component 140.

In other words, the light emitted by the light-emitting unit 130 may be concentrated on a portion of the inclined inner surface 142 of the lighting effect component 140, so that said portion of the inclined inner surface 142 is particularly bright. In addition, since the arc reflector 160 rotates as the fan 120 rotates, based on the persistence of vision method, the entire inclined inner surface 142 of the lighting effect component 140 uniformly emits brighter light. Of course, when the fan 120 rotates at a low speed, since the persistence of vision is not obvious, the light may be reflected by the rotating arc reflector 160 to different portions on the inclined inner surface 142 of the lighting effect component 140, so that a dynamic light effect may be presented.

Figure 7:
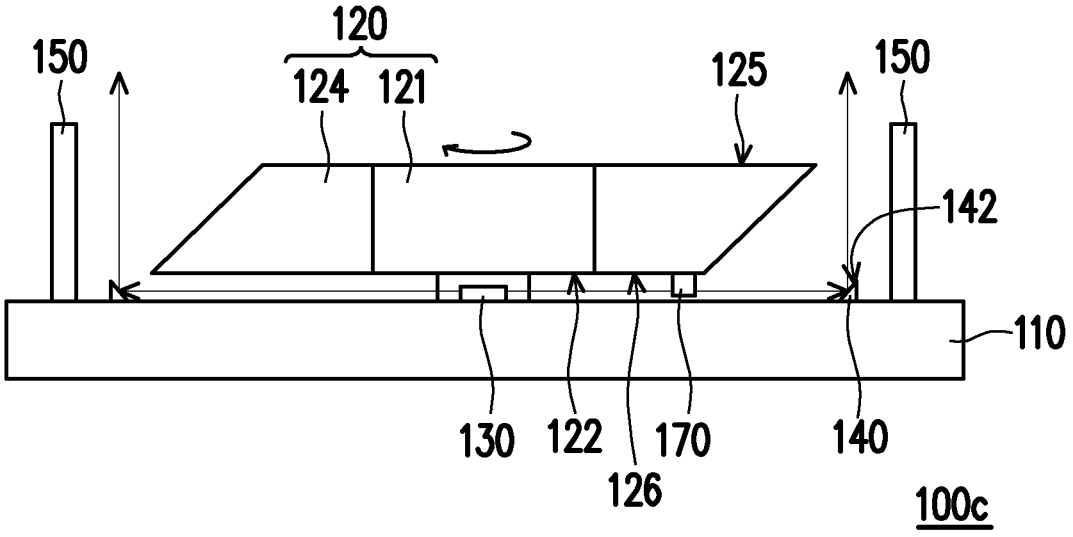
FIG. 7 is a schematic cross-sectional diagram of a fan assembly according to another embodiment of the disclosure.
Figure 8:
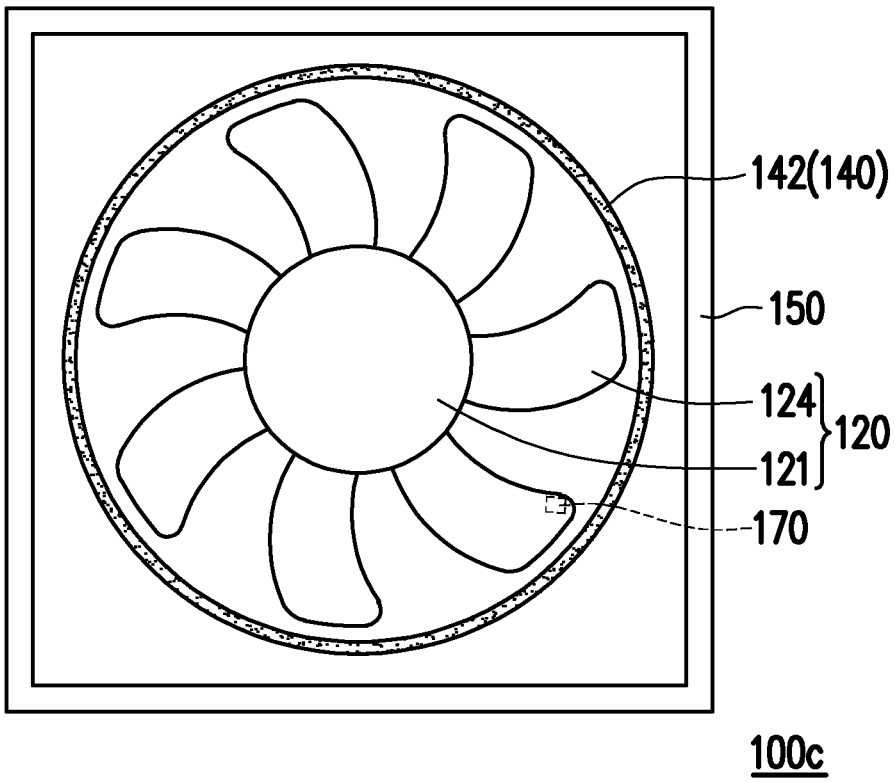
FIG. 8 is a top schematic diagram of the fan assembly of FIG. 7.

FIG. 7 is a schematic cross-sectional diagram of a fan assembly according to another embodiment of the disclosure. FIG. 8 is a top schematic diagram of the fan assembly of FIG. 7. Referring to FIGS. 7 and 8, the main difference between a fan assembly 100*c* in FIG. 7 and the fan assembly 100 in FIG. 1 is as follows. In this embodiment, the fan assembly 100*c* further includes a light-collecting component 170. The light-collecting component 170 is, for example, a convex lens or any component that may collect light. The light-collecting component 170 is disposed on the blade bottom surface 126 of at least one blade 124 and extends towards the direction of the base 110.

The light-collecting component 170 is disposed on an end of the blade bottom surface 126 (in FIG. 7) away from the central part 121. A portion of the light emitted by the light-emitting unit 130 is adapted for being focused on the inclined inner surface 142 by the light-collecting component 170. Therefore, the user may see the visual effect at a rotating and particularly bright point. In other embodiments, the light-collecting component 170 may be disposed on a plurality of blades 124, or the light-collecting component 170 may be disposed on each of the blades 124 to obtain different visual effects.

Figure 9:
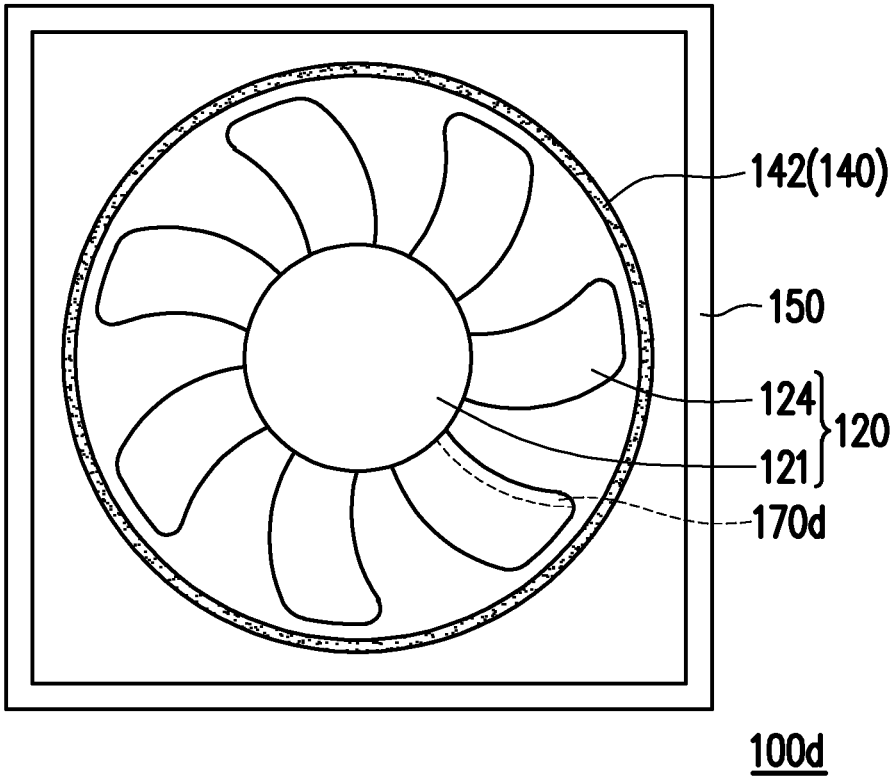
FIG. 9 is a top schematic diagram of a fan assembly according to another embodiment of the disclosure.

FIG. 9 is a top schematic diagram of a fan assembly according to another embodiment of the disclosure. Referring to FIG. 9, the main difference between a fan assembly 100*d* in FIG. 9 and the fan assembly 100*c* in FIG. 8 is as follows. In this embodiment, a light-collecting component 170*d* is a bar-shaped structure, extending from an end close to the central part 121 to an end away from the central part 121 on the blade 124. Therefore, the user may see the visual effect on a rotating and particularly bright bar-shaped area. Similarly, in other embodiments, the light-collecting component 170*d* may be disposed on a plurality of blades 124, or the light-collecting component 170*d* may be disposed on each of the blades 124 to obtain different visual effects.

In summary, the light-emitting unit of the fan assembly of the disclosure is located between the base and the central part of the fan, and the lighting effect component is disposed on the base and surrounds the light-emitting unit. The projection of the lighting effect component onto the base is greater than the projection of the fan onto the base, and the height of the lighting effect component protruding from the base is less than the distance between the blade top surface and the base. The light emitted by the light-emitting unit may be emitted to the inclined inner surface of the lighting effect component, and may be reflected by the inclined inner surface to be directed towards the direction away from the base. With the above design, users may see the visual effect generated by the light being reflected by the lighting effect component from the front side of the fan assembly. In addition, since the height of the lighting effect component protruding from the base is less than the distance between the blade top surface and the base, the low-height lighting effect component is less likely to damage the wind flow of the fan; therefore, a good heat-dissipation effect may still be maintained.

What is claimed is:

1. A fan assembly, comprising:

a base;

a fan, rotatably disposed above the base, comprising a central part and a plurality of blades extending outwards from the central part, wherein each of the blades has a blade top surface away from the base;

a light-emitting unit, disposed on the base, located between the base and the central part of the fan; and a light reflecting component, disposed on the base, surrounding the light-emitting unit, wherein a projection of the light reflecting component onto the base is greater than a projection of the fan onto the base, a height of the light reflecting component protruding from the base is less than a distance between the blade top surface and the base, the light reflecting component comprises an inclined inner surface facing toward the light-emitting unit in an inclined manner, the inclined inner surface is formed from a bottom of the light reflecting component to a top of the light reflecting component, and light emitted by the light-emitting unit directly emits to the inclined inner surface and is reflected towards a direction away from the base.

2. The fan assembly according to claim 1, wherein each of the blades comprises a blade bottom surface opposite to the blade top surface, and the height of the light reflecting component protruding from the base is less than or equal to a distance between the blade bottom surface and the base.

3. The fan assembly according to claim 1, further comprising:

a fan guard, disposed on the base, surrounding the fan and the light reflecting component, wherein a height of the fan guard protruding from the base is greater than or equal to the distance between the blade top surface and the base.

4. The fan assembly according to claim 1, further comprising:

an arc reflector, disposed on a central part bottom surface of the central part of the fan, rotating as the fan rotates, wherein the arc reflector comprises an opening, and a portion of the light emitted by the light-emitting unit is adapted for being reflected by the arc reflector and passing through the opening to be incident on the inclined inner surface.

5. The fan assembly according to claim 1, further comprising:

a light-collecting component, wherein each of the blades comprises a blade bottom surface opposite to the blade top surface, the light-collecting component is disposed on the blade bottom surface of one of the blades and extends towards the direction of the base, and a portion of the light emitted by the light-emitting unit is adapted for being focused on the inclined inner surface by the light-collecting component.

6. The fan assembly according to claim 5, wherein the light-collecting component is disposed on an end of the blade bottom surface away from the central part.

7. The fan assembly according to claim 5, wherein the light-collecting component is a bar-shaped structure extending from an end close to the central part to an end away from the central part of the blade bottom surface.

8. The fan assembly according to claim 1, wherein an inclination angle of the inclined inner surface is between 30 degrees and 60 degrees.

9. The fan assembly according to claim 1, wherein the light-emitting unit comprises a red light-emitting diode, a green light-emitting diode, and a blue light-emitting diode.

10. The fan assembly according to claim 1, wherein the light reflecting component is in a closed annular shape.

* * * * *